US011159899B2

(12) United States Patent
Jeong et al.

(10) Patent No.: US 11,159,899 B2
(45) Date of Patent: Oct. 26, 2021

(54) EARTIP INCLUDING FOREIGN MATTER INFLOW PREVENTION PORTION AND ELECTRONIC DEVICE INCLUDING THE SAME

(71) Applicant: Samsung Electronics Co., Ltd, Suwon-si (KR)

(72) Inventors: Hyeonyeong Jeong, Suwon-si (KR); Kyeongcheol Yoon, Suwon-si (KR); Seeyoun Kwon, Suwon-si (KR); Hansol Kim, Suwon-si (KR); Haekeu Park, Suwon-si (KR); Sunghoon Cho, Suwon-si (KR); Jonghyuk Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/660,622

(22) Filed: Oct. 22, 2019

(65) Prior Publication Data

US 2020/0128340 A1 Apr. 23, 2020

(30) Foreign Application Priority Data

Oct. 22, 2018 (KR) ..... 10-2018-0126149

(51) Int. Cl.
*H04R 25/00* (2006.01)

(52) U.S. Cl.
CPC ..... *H04R 25/654* (2013.01); *H04R 2225/57* (2019.05)

(58) Field of Classification Search
CPC ..... H04R 25/654; H04R 25/656
See application file for complete search history.

(56) References Cited

U.S. PATENT DOCUMENTS 10,448,141 B2 10/2019 Na et al.
2010/0322452 A1* 12/2010 Ladabaum ..... H04R 25/656 381/375

(Continued)

FOREIGN PATENT DOCUMENTS

CN 205987277 U 2/2017
CN 108260047 A 7/2018

(Continued)

OTHER PUBLICATIONS

English machine translation of JP 2013-074592 A (Yagishita et al.; Earpiece and Sound Radiation Device With the Same; published Apr. 2013) (Year: 2013).*

(Continued)

*Primary Examiner* — Mark Fischer

(57) ABSTRACT

An electronic device according to various embodiments includes a housing including an acoustic channel and a nozzle portion having an opening formed therein for connecting the acoustic channel to an outside of the electronic device, and an eartip detachably engaged with the housing through at least a portion of the nozzle portion. The eartip includes a first area, at least a portion of which is formed of an elastic material and comes into contact with an object, and a second area, at least a portion of which is formed of an elastic material and surrounds at least a portion of the nozzle portion. The second area includes a first portion having a hole having a first size and a second portion having a second size larger than the first size, and a protrusion is formed at an end of the second portion in a first direction.

15 Claims, 5 Drawing Sheets

(56) References Cited

U.S. PATENT DOCUMENTS

| | | | | |
|---|---|---|---|---|
| 2015/0049897 | A1* | 2/2015 | Blanchard | H04R 25/656<br>381/380 |
| 2017/0155995 | A1 | 6/2017 | Siahaan et al. | |
| 2018/0184192 | A1* | 6/2018 | Na | H04R 1/1033 |

FOREIGN PATENT DOCUMENTS

| | | | |
|---|---|---|---|
| EP | 1039779 | A2 | 9/2000 |
| EP | 3340644 | A1 | 6/2018 |
| JP | 2013-074592 | A | 4/2013 |
| JP | 2005217475 | A | 8/2015 |
| KR | 10-2017-0098527 | A | 8/2017 |

OTHER PUBLICATIONS

European Search Report dated Apr. 2, 2020 in connection with European Patent Application No. 19 20 4689, 7 pages.
Office Action dated Nov. 30, 2020 in connection with Chinese Patent Application No. 201911005460.2, 21 pages.
Office Action dated Jun. 4, 2021 in connection with Chinese Patent Application No. 201911005460.2, 15 pages.

* cited by examiner

EARTIP INCLUDING FOREIGN MATTER INFLOW PREVENTION PORTION AND ELECTRONIC DEVICE INCLUDING THE SAME

CROSS-REFERENCE TO RELATED APPLICATION

This application is based on and claims priority under 35 U.S.C. 119 to Korean Patent Application No. 10-2018-0126149 filed on Oct. 22, 2018 in the Korean Intellectual Property Office, the disclosure of which is herein incorporated by reference in its entirety.

BACKGROUND

1. Field

Various embodiments relate to an eartip including a foreign matter inflow prevention portion and an electronic device including the same.

2. Description of Related Art

The above information is presented as background information only to assist with an understanding of the disclosure. No determination has been made, and no assertion is made, as to whether any of the above might be applicable as prior art with regard to the disclosure.

With the development of portable electronic devices, portable acoustic output devices (e.g., earbuds, headsets, earphones, etc.) have become a necessity in life. A portable acoustic output device may include a configuration that directly transmits vibrations to a user's eardrum by inserting a speaker that converts an electric signal, generated in an acoustic device or an electronic device, into a sound signal which then enters a user's ear.

Portable acoustic output devices are widely used due to the following reasons: the portable acoustic output devices allow a user to listen to sound with a small output, suppress the sound from leaking out to the surroundings in the process of listening to the sound, and are convenient to carry.

SUMMARY

In a portable acoustic device used in the state of being inserted into an outer ear, such as a canal-type earphone, foreign matter (e.g., liquid earwax), which is transferred from the inner ear and introduced into the outer ear, may be attached to a mesh portion located at an end of the nozzle of the earphone. When the foreign matter solidifies and clogs the mesh, a sound transmission area may be reduced. When the sound transmission area optimized for the structure and performance of the portable acoustic device is reduced, the sound performance may deteriorate.

According to various embodiments, an eartip may include a structure for preventing sweat or liquid foreign matter flowing thereinto through the outer ear from reaching the mesh portion.

An electronic device according to various embodiments may include a housing including an acoustic channel and a nozzle portion having an opening formed therein for connecting the acoustic channel to an outside of the electronic device, and an eartip detachably engaged with the housing through at least a portion of the nozzle portion. The eartip may include a first area, at least a portion of which is formed of an elastic material and comes into contact with an object, and a second area, at least a portion of which is formed of an elastic material and surrounds at least a portion of the nozzle portion. The second area may include a first portion having a hole having a first size and a second portion having a second size larger than the first size, and a protrusion is formed at an end of the second portion in a first direction.

An eartip according to various embodiments may include a first area, at least a portion of which is formed of an elastic material and comes into contact with an external object, a second area, at least a portion of which is formed of an elastic material and surrounds at least a portion of the nozzle portion of an acoustic device, the second area including an empty space, and a foreign matter inflow prevention portion extending from the empty space to a center portion. The foreign matter inflow prevention portion may include an acoustic hole formed in a center of the foreign matter inflow prevention portion, and a protrusion formed around the acoustic hole.

According to various embodiments, it is possible to minimize liquid foreign matter flowing into the nozzle portion and to maintain designed sound performance.

According to various embodiments, liquid foreign matter flowing into an eartip from the outer ear is located on the outer face of the eartip, so that the liquid foreign matter can be easily observed from the outside.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Figure 1:
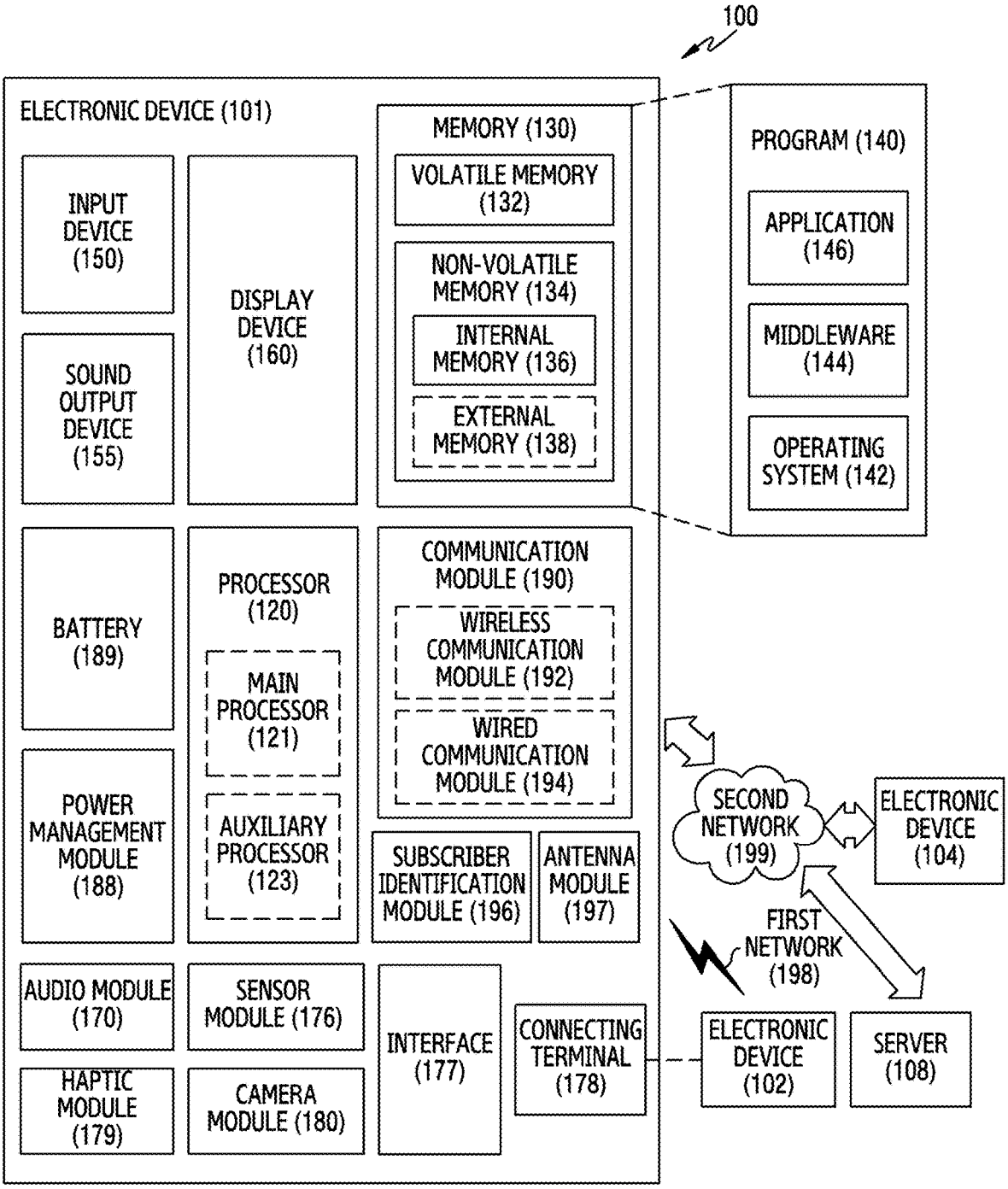
FIG. 1 illustrates a block diagram of an electronic device according to various embodiments in a network environment.

FIG. 1 illustrates a block diagram of an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wired) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wired) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector), The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
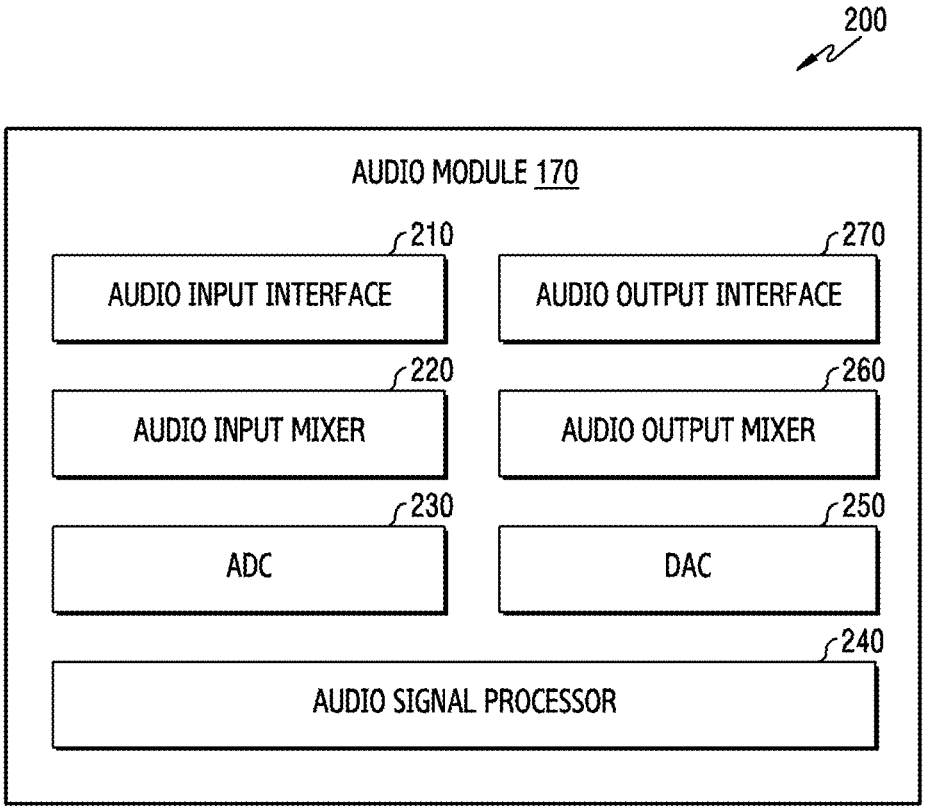
FIG. 2 illustrates a block diagram of an audio module according to various embodiments.

FIG. 2 illustrates a block diagram 200 of the audio module 170 according to various embodiments. Referring to FIG. 2, the audio module 170 may include, for example, an audio input interface 210, an audio input mixer 220, an analogto-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. According to an embodiment, additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor(120) or the memory(l30)) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. According to an embodiment, the audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (not shown) (e.g., a speaker amplifying circuit) that is capable of amplifying an analog audio signal inputted via the audio input interface 210 or an audio signal that is to be outputted via the audio output interface 270. According to an embodiment, the audio amplifier may be configured as a module separate from the audio module 170.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wired), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturers server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 3:
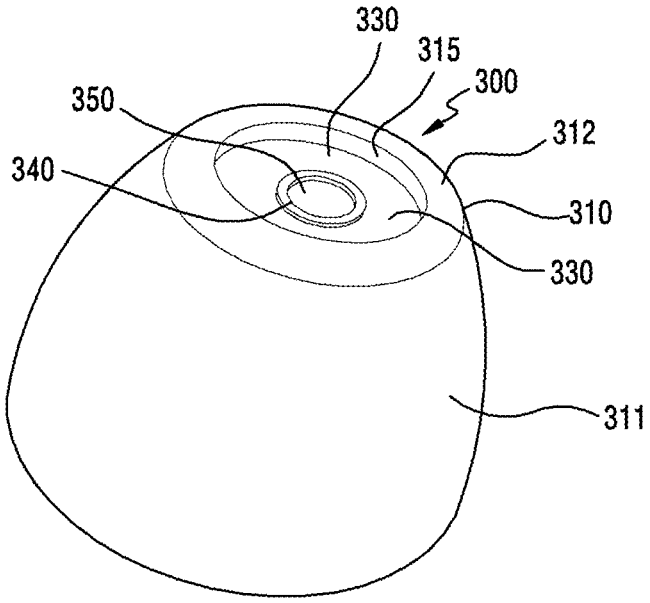
FIG. 3 illustrates a perspective view of an eartip according to various embodiments.
Figure 4:
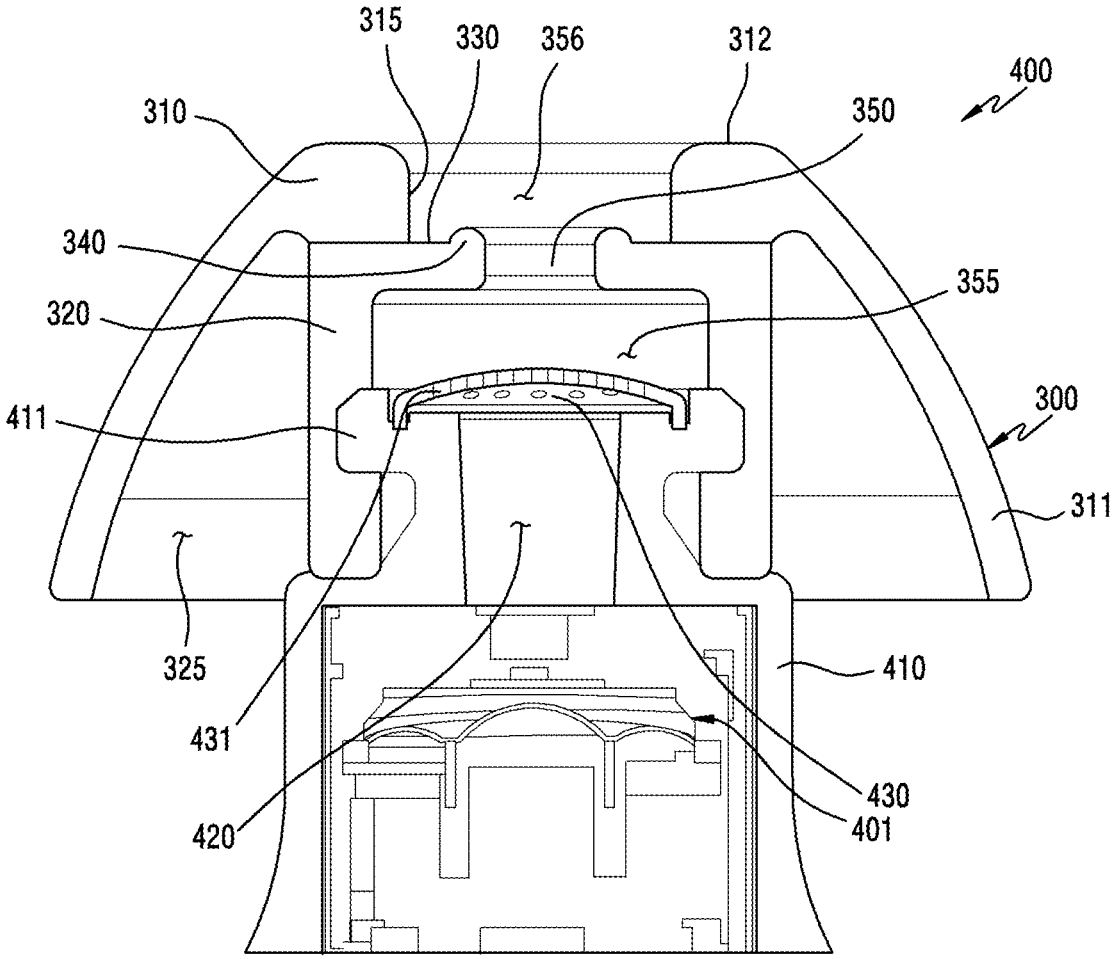
FIG. 4 illustrates a cross-sectional view of an electronic device including an eartip according to various embodiments.
Figure 5:
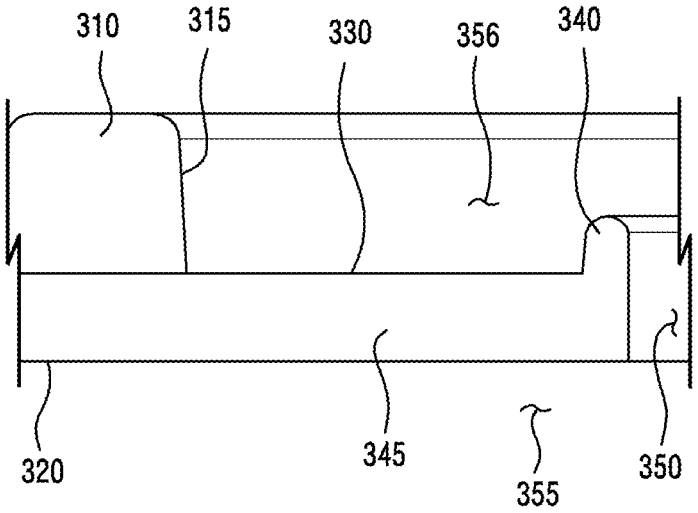
FIG. 5 illustrates an enlarged cross-sectional view of an upper groove in the electronic device of FIG. 4.

FIG. 3 illustrates a perspective view of an eartip according to various embodiments, FIG. 4 illustrates a cross-sectional view of an electronic device including an eartip according to various embodiments, and FIG. 5 illustrates an enlarged cross-sectional view of an upper groove in the electronic device of FIG. 4.

Referring to FIGS. 3 and 4, an eartip 300 may include a first eartip-forming portion 310 formed of an elastic material and forming an outer appearance of the eartip 300. The first eartip-forming portion 310 may be directly inserted into the outer ear of a user so as to be deformed to conform to the shape of the outer ear. The rear face of the eartip 300 may include a fastening structure capable of being engaged with an acoustic device, and the front face of the eartip 300 includes an acoustic hole 350 capable of transmitting sound waves transmitted from the acoustic device.

According to various embodiments, the eartip 300 may include an upper groove 330 in which an acoustic hole 350 is formed and a side face 311 extending from the upper groove 330. The upper groove 330 may include a stepped portion 315 extending to the upper face 312 of the first eartip-forming portion 310. The upper groove 330 may be formed between the stepped portion 315 and the acoustic hole 350. The stepped portion 315 formed from the upper face 312 of the first eartip-forming part 310 is arranged to surround the acoustic hole 350 and an outer acoustic hole 356 may be a space surrounded by the stepped portion 315. The outer acoustic hole 356 is able to transmit a voice signal transmitted through the acoustic hole 350 to the user's ear.

According to various embodiments, the upper groove 330 may include a protrusion 340 formed around the acoustic hole 350 of the eartip 300. The protrusion 340 may be formed in a ring shape corresponding to the shape of the acoustic hole 350 of the eartip 300. When the acoustic hole 350 is circular, the acoustic hole 350, the protrusion 340, and the stepped portion 315 may be disposed concentrically. The protrusion 340 may be disposed between the upper groove 330 and the acoustic hole 350. The protrusion 340 may protrude from the upper groove 330 with a predetermined height. The upper groove 330 may be formed between the stepped portion 315 and the protrusion 340.

According to various embodiments, when the eartip 300 is inserted into the user's outer ear, the side face 311 of the first eartip-forming portion 310 may be deformed to conform to the shape of the outer ear.

According to various embodiments, when the first eartip-forming portion 310 is located in the user's outer ear, foreign matter flowing from the user's inner ear may be delivered to the eartip 300 to be accumulated in the upper groove 330 in the eartip 330. The foreign matter accumulated in the upper groove 330 in the eartip 300 is prevented from moving to the acoustic hole 350 by the protrusion 340 and the stepped portion 315, and may be located in the upper groove 330. The upper groove 330 of the eartip 300 is visually perceivable by the user when the eartip 300 is separated from the user's ear. Thus, the user may remove the foreign matter accumulated in the upper groove 330, or may replace the eartip 300 mounted on the acoustic device with a new one.

According to various embodiments, an electronic device 400 (e.g., the electronic device 102 in FIG. 1) may include an acoustic output device 401 and the eartip 300.

According to various embodiments, the electronic device 400 may include a device that is capable of transmitting sound to the user's ear (e.g., a headset or an earphone). At least a part of the electronic device 400 may be inserted into the user's ear so as to be seated in the outer ear. The electronic device 400 may receive an electric signal from an audio module (e.g., the audio module 170 in FIG. 1) or an acoustic output device (e.g., the acoustic output device 155 in FIG. 1) of another electronic device (e.g., the electronic device 101 in FIG. 1, may convert the received electrical signal into a sound signal, and may transmit the sound signal to the user as a voice signal.

According to various embodiments, the electronic device 400 may be electrically connected to a connection terminal 178 of another electronic device (e.g., the electronic device 101 in FIG. 1) through a connector of the electronic device 400.

According to various embodiments, the electronic device 400 may be connected to the audio module (e.g., the audio module 70 of FIG. 1) in a wired or wireless manner so as to receive an audio signal.

According to various embodiments, the electronic device 400 may include a housing 410, an acoustic channel 420, and a sound transmission unit 430.

According to various embodiments, the housing 410 may include the acoustic channel 420 capable of transmitting a voice signal, and may include an empty space, which may include a module capable of converting an electrical signal to a voice signal or the like. The acoustic channel 420 is a channel through which a signal converted from an electric signal into a voice signal (e.g., an acoustic wave signal) is transmitted, and the transmitted voice signal may be transmitted to the user's ear through the sound transmission unit 430 disposed inside the housing 410.

According to various embodiments, the acoustic channel 420 may have a cylindrical shape, and may be connected to the sound transmission unit 430 including an opening 431 at one end thereof. The other end of the acoustic channel 420 may be disposed adjacent to an output unit of the acoustic output device 401. The acoustic output device 401 may be connected to an audio module that converts an electrical signal into a voice signal, and the voice signal transmitted from the audio module may be transmitted to the user's ear through the acoustic output device 401, the acoustic channel 420, and the sound transmission unit 430.

According to various embodiments, the sound transmission unit 430 may include a plurality of openings 431, through which the sound may be transmitted to the user's ear through the openings 431. The sound transmission unit 430 may be formed of the plurality of openings 431, but may be formed in a mesh type including openings in the form of a fine pattern. The sound transmission unit 430 including the openings 431 may be disposed at an end of the acoustic channel 420, and a nozzle portion 411 may be formed around the sound transmission unit 430 so as to be fastened to the eartip 300.

According to various embodiments, the nozzle portion 411 may be formed at an end of the housing 410, and the nozzle portion 411 may be engaged with the sound transmission unit 430. The nozzle portion 411 may include a protrusion formed along the periphery of the housing 410 so as to be engaged with the eartip 300.

According to various embodiments, the eartip 300 may be formed of an elastic material as a whole, and may be detachably coupled to the housing 410 through the protrusion formed on the nozzle portion 411. The eartip 300 may include a first eartip-forming portion 310, a second eartip-forming portion 320, and the protrusion 340.

According to various embodiments, the first eartip-forming portion 310 may be directly inserted into the user's outer ear so as to be deformed to conform to the shape of the outer ear. The first eartip-forming portion 310 may be elastically deformed, and the side face 311 of the first eartip-forming portion 310 may be deformed to conform to the user's outer ear. The side face 311 of the first eartip-forming-portion 310 may be formed to be spaced away from the second eartip-forming portion 320, and the eartip 300 may have an inner space 325 formed between the side face 311 of the first eartip-forming portion 310 and the second ear-tip forming portion 320. The first eartip-forming portion 310 may be easily deformed with the aid of the empty inner space 325. The rear face of the eartip 300 may include a fastening structure capable of being engaged with an acoustic device, and the front face of the eartip 300 may include an acoustic hole 350 capable of transmitting sound waves transmitted from the acoustic device.

According to various embodiments, the first eartip-forming portion 310 may include a side face 311, and the side face 311 may form the internal space 325. In the inner space 325 of the first eartip-forming portion 310, the second eartip-forming portion 320 and the acoustic output device 401 may be positioned.

According to various embodiments, the second ear-tip forming portion 320 may have a certain degree of hardness so as to be fixed to the nozzle portion 411 and to maintain the shapes of the entire eartip 300 and the inner acoustic hole 355 when worn in the user's ear. Since it is necessary the second ear-tip forming portion 320 to be attachable to/detachable from the housing 410 through the nozzle portion 411, the second eartip-forming portion 320 may be formed of a material having a certain level of elasticity. According to an embodiment, the first eartip-forming portion 310 may be made of a material having a hardness slightly lower than that of the second eartip-forming portion 320 so as to provide a good wearing sensation when worn in the user's ear. According to various embodiments, the first and second eartip-forming portions 310 and 320 may be integrally formed or separately formed and joined together.

Referring to FIG. 5, the eartip 300 may include a foreign matter inflow prevention portion 345 between the first and second eartip-forming portions 310 and 320.

According to various embodiments, the foreign matter inflow prevention portion 345 may be formed to extend from the first or second eartip-forming portion 310 or 320 to the center of the acoustic hole 350. According to various embodiments, the foreign matter inflow prevention portion 345 may be formed in the form of a thin film. The foreign matter inflow prevention portion 345 may be formed to be spaced apart from the sound transmission unit 430, and the inner acoustic hole 355 may be formed in the second eartip-forming portion 320 by the spaced distance. The foreign matter inflow prevention portion 345 may be formed between the inner acoustic hole 355 and the outer acoustic hole 356.

According to various embodiments, the foreign matter inflow prevention portion 345 may include the acoustic hole 350 formed in the center thereof and the protrusion 340 formed around the acoustic hole 350.

According to various embodiments, the acoustic hole 350 may be a passage for transmitting a voice signal transmitted through the openings 431 to the user. The acoustic hole 350 may open to communicate with the outside through the openings 431. According to an embodiment, during the use of the electronic device 400, foreign matter (e.g., liquid earwax) entering from the user's inner ear may reach the openings 431. According to various embodiments, the acoustic hole 350 may be formed narrowly at a level of about 0.25 mm or less to prevent the foreign matter from reaching the openings 431.

According to various embodiments, the protrusion 340 may be formed around the acoustic hole 350. The protrusion 340 may be disposed apart from the stepped portion 315 of the first eartip-forming portion 310. A groove may be formed between the stepped portion 315 and the protrusion 340, and the foreign matter inflow prevention portion 345 may include the upper groove 330. The upper groove 330 may allow the liquid foreign matter delivered from the user's inner ear to be seated in the upper groove 330, rather than moving to the acoustic hole 350. The liquid foreign matter delivered from the user's inner ear may reach the outside of the first eartip-forming portion 310, and may flow over the stepped portion 315 to reach the upper groove 330. In order for the foreign matter positioned in the upper groove 330 to be delivered to the openings 431 through the acoustic hole 350, it is necessary for the foreign matter to flow over the protrusion 340. However, since the foreign matter is viscous, and thus is able to be positioned in the upper groove 330. Since the protrusion 340 and the stepped portion 315 surround the upper groove 330, the protrusion 340 and the stepped portion 315 are able to prevent the viscous foreign matter positioned in the upper groove 330 from flowing into the acoustic hole 350.

According to various embodiments, most of the foreign matter that is not able to flow over the protrusion 340 are located in the upper groove 330, and when the user does not use the acoustic device, the user may observe the foreign matter positioned in the upper groove 330 and may replace the eartip 300 or the clean the eartip 300.

Hereinafter, an operation method of various embodiments will be described based on the drawings according to various embodiments.

According to various embodiments, a user may use the electronic device 400 by inserting the eartip 300 into the user's ear. Foreign matter may be delivered to the outer ear through the inner ear, and may then be delivered to the eartip 300 from the outer ear. The foreign matter delivered to the eartip 300 may flow down along the stepped portion 315 formed in the first eartip-forming portion 310 of the eartip 300. The downward flowing foreign matter may be seated in the upper groove 330. The protrusion 340 may prevent the seated foreign matter from flowing over the protrusion 340 and passing through the acoustic hole 350.

According to various embodiments, when the user stops using the electronic device 400 and removes the electronic device 400 from the user's ear, the foreign matter seated in the upper groove 330 may be visually recognized by the user.

According to various embodiments, the user may remove the foreign matter seated in the upper groove 330, and may detach the eartip 300, and may clean or replace the eartip with a new eartip 300.

According to various embodiments, an electronic device (e.g., the electronic device 102 in FIG. 1) includes: a housing (e.g., the housing 410 in FIG. 4) including an acoustic channel (e.g., the acoustic channel 420 in FIG. 4) and a nozzle portion (e.g., the nozzle portion 411 in FIG. 4) having an opening (e.g., the opening 431 in FIG. 4) formed therein for connecting the acoustic channel to the outside of the electronic device; and an eartip (e.g., the eartip 300 in FIG. 4) detachably engaged with the housing through at least a portion of the nozzle portion. The eartip includes a first area (e.g., the first eartip-forming portion 310 in FIG. 4), at least a portion of which is formed of an elastic material and comes into contact with an object, and a second area (e.g., the second eartip-forming portion 320 in FIG. 4), at least a portion of which is formed of an elastic material and surrounds at least a portion of the nozzle portion. The second area includes a first portion having a hole (e.g., the acoustic hole 350 in FIG. 4) having a first size and a second portion having a second size larger than the first size, and a protrusion (e.g., the protrusion 340 in FIG. 4) is formed at an end of the second portion in a first direction.

According to various embodiments, the first area may have a first level of hardness.

According to various embodiments, the second area may have a second level of hardness which is higher than the first level of hardness, and may surround at least a portion of the nozzle portion.

According to various embodiments, the protrusion may prevent foreign matter from moving an area above the opening.

According to various embodiments, the nozzle portion may include an engagement protrusion and the second area has an engagement groove corresponding to the engagement protrusion.

According to various embodiments, an eartip (e.g., the ear tip 300 in FIG. 4) may include: a first area (e.g., the first eartip-forming portion 310 in FIG. 4), at least a portion of which is formed of an elastic material and comes into contact with an external object; a second area (e.g., the second eartip-forming portion 320 in FIG. 4), at least a portion of which is formed of an elastic material and surrounds at least a portion of a nozzle portion (e.g., the nozzle portion 411 in FIG. 4) of an acoustic device (e.g., the acoustic device 400 in FIG. 4), the second area including an empty space; and a foreign matter inflow prevention portion (e.g., the upper groove 330 in FIG. 4) extending from the empty space to a center portion. The foreign matter inflow prevention portion may include an acoustic hole (e.g., the acoustic hole 350 in FIG. 4) formed in a center of the foreign matter inflow prevention portion, and a protrusion (e.g., the protrusion 340 in FIG. 4) formed around the acoustic hole.

According to various embodiments, the foreign matter inflow prevention portion may include a film (e.g., the foreign matter inflow prevention portion 345 in FIG. 5) formed at an end of the empty space.

According to various embodiments, the foreign matter inflow prevention portion may extend from the first area to a center of the empty space.

According to various embodiments, the foreign matter inflow prevention portion may extend from the second area to a center of the empty space.

According to various embodiments, the film may be spaced apart from the nozzle portion (e.g., the nozzle portion 411 in FIG. 4) of the acoustic device.

According to various embodiments, the first area may include an outer acoustic hole (e.g., the outer acoustic hole 356 in FIG. 4) connected to the empty space, the outer acoustic hole may be connected to the end of the empty space, and the foreign matter inflow prevention portion may be disposed between the outer acoustic hole and the empty space.

According to various embodiments, foreign matter entering from the external object may be seated in a space formed between the side wall of a penetration portion and the protrusion.

According to various embodiments, the first area may include an inner space in which the second area is capable of being disposed.

According to various embodiments, the hardness of the first area may be smaller than the hardness of the second area.

According to various embodiments, the first area is deformable to be conformable to a shape of a user's outer ear, and the second area is attachable to/detachable from the nozzle portion (e.g., the nozzle portion 411 in FIG. 4) of the acoustic device and is capable of maintaining the empty space.

In the above-described detailed embodiments of the disclosure, a component included in the disclosure is expressed in the singular or the plural according to a presented detailed embodiment. However, the singular form or plural form is selected for convenience of description suitable for the presented situation, and various embodiments of the disclosure are not limited to a single element or multiple elements thereof. Further, either multiple elements expressed in the description may be configured into a single element or a single element in the description may be configured into multiple elements.

Although the present disclosure has been described with various embodiments, various changes and modifications may be suggested to one skilled in the art. It is intended that the present disclosure encompass such changes and modifications as fall within the scope of the appended claims.

What is claimed is:

1. An electronic device comprising:

a housing including an acoustic channel and a nozzle portion including:

an opening formed therein for connecting the acoustic channel to an outside of the electronic device, and an engagement protrusion; and an eartip detachably engaged with the housing through at least a portion of the nozzle portion, wherein the eartip includes:

a first area, at least a portion of which is formed of an elastic material and comes into contact with an object, a second area, at least a portion of which is formed of an elastic material and surrounds at least a portion of the nozzle portion, wherein the second area includes a surface defining an inner acoustic hole having a first size and an engagement groove formed in the surface corresponding to the engagement protrusion, and a protrusion formed extending from the surface of the second area at an end of the second area in a first direction to prevent foreign matter from moving to an area on the opening, the protrusion defining an acoustic hole having a second size smaller than the first size, and wherein a portion of the first area forms an outer acoustic hole proximate to the protrusion and the portion of the first area forming the outer acoustic hole has a first level of hardness that is lower than a second level of hardness for the second area and the protrusion.

2. The electronic device of claim 1, wherein the second area surrounds at least a portion of the nozzle portion.

3. The electronic device of claim 1, wherein the housing further includes a sound transmission unit coupled to the acoustic channel.

4. The electronic device of claim 3, wherein the sound transmission unit includes a plurality of openings, through which sound is transmitted to a user's ear.

5. The electronic device of claim 3, wherein the sound transmission unit is disposed at an end of the acoustic channel.

6. The electronic device of claim 3, wherein the acoustic channel comprises a cylindrical shape.

7. The electronic device of claim 3, wherein the nozzle portion is coupled to the sound transmission unit.

8. An eartip comprising:

a first area, at least a portion of which is formed of an elastic material and comes into contact with an external object, including an outer acoustic hole;

a second area, at least a portion of which is formed of an elastic material, the second area including:

a surface defining an inner acoustic hole of which an end is connected to the outer acoustic hole of the first area, and an engagement groove formed in the surface of the second area and capable of attaching with a corresponding groove of an external electronic device; and a foreign matter inflow prevention portion disposed between the outer acoustic hole and the inner acoustic hole, wherein the foreign matter inflow prevention portion includes:

an acoustic hole formed in a center of the foreign matter inflow prevention portion, and a protrusion formed extending from the surface of the second area around the acoustic hole, and wherein a portion of the first area forms an outer acoustic hole proximate to the protrusion and the portion of the first area forming the outer acoustic hole has a first level of hardness that is lower than a second level of hardness for the second area and the protrusion.

9. The eartip of claim 8, wherein the foreign matter inflow prevention portion includes a film formed at an end of the inner acoustic hole.

10. The eartip of claim 9, wherein the film is spaced apart from a nozzle portion of an acoustic device.

11. The eartip of claim 8, wherein the foreign matter inflow prevention portion extends from the first area to a center of the inner acoustic hole.

12. The eartip of claim 8, wherein the foreign matter inflow prevention portion extends from the second area to a center of the inner acoustic hole.

13. The eartip of claim 8, wherein foreign matter entering from the external object stays in a space formed between a side wall of a penetration portion and the protrusion.

14. The eartip of claim 8, wherein the first area includes an inner space in which the second area is configured to be disposed.

15. The eartip of claim 8, wherein:

the first area is deformable to be conformable to a shape of a user's outer ear, and the second area is attachable to/detachable from a nozzle portion of an acoustic device and is configured to maintain the inner acoustic hole.

* * * * *